United States Patent [19]

Dawes et al.

[11] Patent Number: 4,496,401

[45] Date of Patent: Jan. 29, 1985

[54] CORROSION RESISTANT STEEL COMPONENTS AND METHOD OF MANUFACTURE THEREOF

[75] Inventors: Cyril Dawes, Sutton Coldfield; John D. Smith, Solihull, both of England

[73] Assignee: Lucas Industries, Birmingham, England

[21] Appl. No.: 433,380

[22] Filed: Oct. 8, 1982

[30] Foreign Application Priority Data

| | | | |
|---|---|---|---|
| Oct. 15, 1981 | [GB] | United Kingdom | 8131133 |
| Dec. 18, 1981 | [GB] | United Kingdom | 8138318 |
| Feb. 26, 1982 | [GB] | United Kingdom | 8205999 |
| Jul. 15, 1982 | [GB] | United Kingdom | 8220495 |

[51] Int. Cl.[3] ..... C23C 11/14

[52] U.S. Cl. ..... 148/16.5; 148/16.6; 148/31.5

[58] Field of Search ..... 148/16.6, 31.5, 6.35, 148/16.5, 16, 18; 427/416

[56] References Cited

U.S. PATENT DOCUMENTS

| | | | |
|---|---|---|---|
| 3,479,229 | 11/1969 | Becker | 427/416 |
| 4,131,492 | 12/1978 | Fushimi et al. | 148/31.5 |

FOREIGN PATENT DOCUMENTS

| | | | |
|---|---|---|---|
| 119822 | 5/1976 | German Democratic Rep. . | |
| 53-371 | 1/1978 | Japan . | |
| 55-24916 | 2/1980 | Japan | 148/16.6 |
| 55-129176 | 10/1980 | Japan | 148/16.6 |
| 56-23841 | 4/1981 | Japan . | |
| 56-47561 | 4/1981 | Japan . | |
| 56-58963 | 5/1981 | Japan . | |
| 56-84416 | 7/1981 | Japan | 148/16.6 |
| 64731 | 4/1972 | Poland . | |
| 395520 | 1/1974 | U.S.S.R. | 148/16.6 |
| 767233 | 10/1980 | U.S.S.R. | 148/16.6 |

*Primary Examiner*—Peter K. Skiff

*Attorney, Agent, or Firm*—Ladas & Parry

[57] ABSTRACT

A non-alloy steel component is nitrocarburized at 550° to 720° C. for up to 4 hours in a nitriding gaseous atmosphere eg. ammonia or ammonia and endothermic or exothermic gas, and is thus exposed to air or other oxidizing atmosphere for 2 to 120 seconds to form an oxide-rich layer thereon before being quenched into an oil/water emulsion, degreased and a tack-free wax coating applied. Alternatively, the component may be cooled in air or other oxidizing atmosphere and then wax coated or it may be cooled in a non-oxidizing atmosphere and then reheated to provide the oxide-rich surface layer before being cooled again and wax coated. As a further alternative, the component may be cooled, lapped to a surface roughness of not more than 0.2 micrometers Ra, reheated to oxidize and then quenched. These techniques give a good corrosion resistance to the component.

17 Claims, 6 Drawing Figures

CORROSION RESISTANT STEEL COMPONENTS AND METHOD OF MANUFACTURE THEREOF

Figure 1:
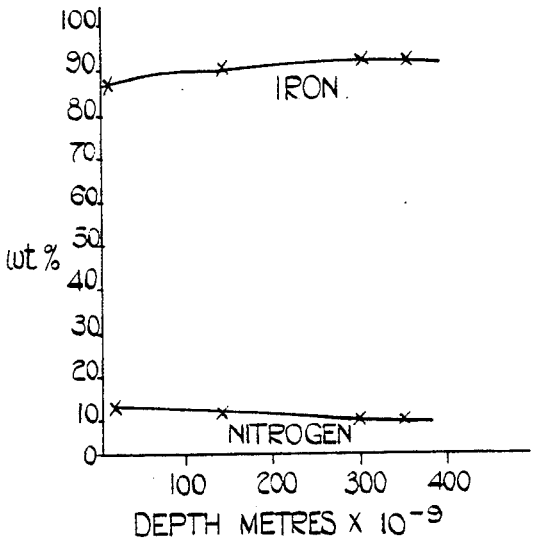

This invention relates to corrosion resistant steel components and to a method of manufacture thereof.

It is known to improve the corrosion resistance of steel components by heat treating such components by two successive molten salt bath treatments. The first salt bath heat treatment is effected for about 2 hours at 580° C. in a potassium cyanide/potassium cyanate bath. The second heat treatment is effected by quenching the components at 400° C. for about 10 minutes in a second salt bath containing sodium hydroxide, potassium hydroxide, and sodium nitrate. This is followed by water quenching of the component. If it is important to restore the oxidized surface of the product to its original finish, it may be necessary to effect a lapping operation at this stage followed by re-treatment in the oxidizing bath for 20 minutes at about 400° C. again followed by water quenching.

The above process suffers from a number of disadvantages which are as follows:

1. Toxic chemicals are used which present environmental hazards.

2. In order to oxidize the toxic cyanide salt carried over from the initial hardening treatment to produce a relatively harmless carbonate salt, a double oxidation route is necessary 3. Water quenching after the oxidizing treatments is essential to ensure removal of the salts carried over from the treatment. This in turn leads to further effluent disposal problems.

It is an object of the present invention to obviate or mitigate at least some of the above disavantages.

According to one aspect of the present invention, there is provided a corrosion resistant, non-alloy steel component which has been manufactured by forming an epsilon iron nitride layer on the surface of the component by a gaseous heat treatment, with subsequent oxidation of the surface also by a gaseous treatment to provide an oxide-rich surface layer.

Also according to the present invention, there is provided a method of manufacturing a corrosion resistant non-alloy steel component comprising the steps of heat treating a non-alloy steel component in a nitriding gaseous atmosphere to produce an epsilon iron nitride surface layer thereon, and subsequently heat treating the component in an oxidizing atmosphere to provide an oxide-rich surface layer.

With regard to the step of heat treating the component in a nitriding gaseous atmosphere to form the epsilon iron nitride surface layer, this step is typically effected at a temperature in the range of 550° to 720° C. for up to 4 hours in an atmosphere of ammonia, ammonia and endothermic gas, ammonia and exothermic gas or ammonia and nitrogen, with the optional inclusion of at least one of carbon dioxide, carbon monoxide, air, water vapour and methane. The terms "exothermic gas" and "endothermic gas" are well understood in the art. Carbon dioxide, carbon monoxide, air, water vapour and exothermic gas are oxidising gases. Carbon dioxide, methane and endothermic gas are carburizing gases. It is preferred to effect the heat treatment operation so that the epsilon iron nitride surface layer has a thickness of about 25 micrometers. Thicknesses greater than about 25 micrometer can lead to exfoliation or cracking of the surface layer. Typically, such a layer thickness of about 25 micrometers can be obtained by heat treatment at 660° C. for 45 minutes. Such a layer thickness may also be produced by heat treatment of 570° C. for 3 hours or at 610° C. for 90 minutes. However, the heat treatment temperatures and times may be employed to produce layer thicknesses less than 25 micrometers, e.g. down to 15 micrometers. For example, heat treatment of 570° C. for 2 hours can be employed to produce a layer thickness of 16 to 20 micrometers.

In the case of components where good engineering properties are required, e.g. wiper linkages, horn bodies, hose clips, alternator cooling fans, automobile propellor shafts, and fasteners e.g. self-tapping screws, it is preferred to perform the oxidation step before the temperature falls below 550° C. and then to quench so as to retain nitrogen in solid solution in the ferritic matrix of the steel thereby to retain the fatigue and yield strength properties. Typically, the oxidation step is effected for at least two seconds by exposing the component to air or other oxidising atmosphere before quenching. It is preferred to limit the oxidation so that the depth of oxide penetration into the component does not exceed one micrometer. Oxidation penetration to greater depths can lead to oxide exfoliation in service. It is, however, preferred to ensure that oxygen penetration into the component is to a depth of at least 0.2 micrometers, i.e. that the thickness of the oxide layer is at least 0.2 micrometer. More preferably, the oxide layer has a thickness of 0.2 to 0.7 micrometer, most preferably 0.5 micrometer. One way of controlling depth of oxygen penetration is to limit the exposure time of the component to the oxidising atmosphere. In the case where oxidation is effected by exposure to air, the exposure time typically does not exceed 120 seconds. Exposure times of greater than 120 seconds tend to produce an oxide layer exceeding one micrometer in thickness, thus increasing the risk of exfoliation of the surface layer in service. Preferably, the exposure time of the component to air is 2 to 20 seconds. If the oxidising atmosphere to which the component is exposed is at the ambient temperature of heat treatment furnace surroundings (i.e. about 30° C.), then the component may cool to a temperature below 550° C. in a relatively short time. This is a factor which must be taken into consideration where good engineering properties are required of the component since it is important to ensure that nitrogen is retained in the ferritic matrix of the steel microstructure by quenching before the temperature falls below 550° C.

Quenching is preferably effected into an oil/water emulsion. In the case of components which have been oxidised and then quenched into an oil/water emulsion, an aesthetically pleasing black finish is obtained. Quenching the component directly into an oil/water emulsion without the intermediate oxidation step does not give a black finish but a grey finish where the oxide layer is only 0.1 micrometers thick. However, quenching an already oxidised component into the oil/water emulsion does increase the degree of oxidation to a small extent and thereby darkens the colour.

During quenching in the oil/water emulsion, an atmosphere of steam is produced as a small pocket around the component within the emulsion to give a controlled cooling rate. This will give a distortion-free component with maximum properties (e.g. a component less than 1.5 milli-meter thick can have an yield strength of up to 800 MPa).

Quenching into the oil/water emulsion after oxidation produces a black surface with extremely good corrosion resistance and, by virtue of the residual oily film, improved bearing properties, if these are required. An oil-free or dry surface finish with a salt spray corrosion resistance in excess of 240 hours can be obtained by vapour degreasing the as-quenched component and then treating it with a hard film solvent-deposited corrosion preventive material, e.g. a hard wax. This treatment by either dipping or spraying can be effected at room temperature and can still give improved bearing properties, if such are required. In a particular embodiment, a steel component, after having had an epsilon iron nitride surface layer formed thereon by heat treatment at 570° C. for about 2 hours in an atmosphere 50% ammonia and 50% endothermic gas mixture is exposed to ambient air for two seconds to effect surface oxidation and then immersed in a bath of an oil-in-water emulsion which, in this embodiment, is produced by mixing a soluble oil sold under the trade mark EV-COQUENCH GW with water in an oil:water volume ratio of 1:6. Since the component being quenched is at a temperature greater than 550° C., the resultant product has a good fatigue strength and yield strength in addition to having an aesthetically pleasing black surface with extremely good resistance to corrosion and good bearing properties in view of the absorption of oil into the surface. An oil-free or dry surface finish can be obtained by vapour degreasing the quenched component and then treating it with a hard (i.e. tack-free film), solvent-deposited corrosion preventative wax (e.g. CASTROL V425). Such a wax composition contains waxy aliphatic and branched chain hydrocarbons and Group 2a metal soaps, preferably calcium and/or barium soaps. The amount of wax coating on the component is preferably up to 7 $g/m^2$ of component surface. At coating weights greater than 7 $g/m^2$, the coated component tends to become tacky, whereas a tack-free finish is advantageous for ease of processing and handling. For good corrosion resistance, the wax coating weight is preferably a minimum of 2 $g/m^2$.

In the case of components where good engineering properties are not a primary requisite, for example, small motor yokes, it is possible to effect the oxidation step by fast cooling the component in air or other oxidising atmosphere. In such cases, the oxide layer thickness may exceed one micrometer. However, it is preferred to arrange the oxidation and cooling step to be such that the oxide layer thickness is the same as described above with reference to components where good engineering properties are required. As a result of fast cooling of the component in air or other oxidising atmosphere, there will be a tendency for the nitrogen to come out of solid solution, with the result that the fatigue and yield strengths will be adversely affected. However, this will not normally be a problem in the case of components where good engineering properties are not required. On the other hand, avoidance of quenching into oil or an oil/water emulsion has the advantage that degreasing is not required before the component is coated with an oil-incompatible paint or a wax. With wax coating, it is preferred to use the same type of wax composition and coating weight therefor mentioned above with reference to components required to have good engineering properties. It is, however, within the scope of the invention to immerse the cooled oxidised component into oil in order to absorb oil into the surface to improve the salt spray corrosion resistance, to lower the coefficient of friction and/or to improve the aesthetic appearance of the component. In the above two alternative methods according to the invention, the oxidation step is effected immediately after the heat treatment of the component in the nitriding gaseous atmosphere, i.e. before it has cooled. However, it is within the scope of the present invention to effect the oxidation step at a later stage. Thus, after the component has been heat treated in the nitriding gaseous atmosphere, it can be cooled by any desired method in a non-oxidising atmosphere and then subsequently re-heated in air or other oxidising atmosphere to 350° to 550° C. for a suitable period of time to provide the required oxide layer. The treatment time will depend upon the temperature, the lower the temperature, the longer the treatment time. For a treatment temperature range of 350° to 550° C., the typical time range will be 30 minutes to 2 minutes. Following re-heating in air or other oxidising atmosphere, the component may then be quenched or fast cooled as described above with reference to the two previous methods. Following this, the component may be provided with a wax coating in the manner described hereinabove, after degreasing if necessary.

In the case where the component is required to have a fine surface finish without the need to have a wax protection system to give a good corrosion resistance, for example a damper rod or a piston rod, which is often hard chromium plated, the component may, after being heat treated in the nitriding gaseous atmosphere, be cooled in any desired medium, and then subjected to a lapping or other mechanical surface finishing process to a surface roughness of, for example, not more than 0.2 micrometers Ra. This lapping or polishing process will remove any oxide film which may have formed on the component, depending upon the medium used for cooling. After the lapping or polishing process, the component can then be oxidised at a temperature of 300° to 600° C. The actual temperature depends upon the appearance required of the steel component and, more importantly, upon the properties thereof. If the component is a component such as a damper rod which is not required to have very high fatigue properties, then the oxidising heat treatment is preferably effected at 350° to 450° C. for about 15 to 5 minutes depending upon the temperature in unstripped exothermic gas. However, for good fatigue properties, the component is preferably heat treated at 500° to 600° C., more preferably, 550° to 600° C. followed by quenching to retain nitrogen in solid solution in the ferritic matrix of the steel microstructure. Instead of using unstripped exothermic gas, another type of oxidising atmosphere may be employed such as steam, air or other mixture of oxygen and nitrogen, carbon dioxide and nitrogen, or carbon dioxide alone or any mixture of these gases. It is possible to use these oxidising atmospheres in the previously described processes not involving lapping or polishing, as an alternative to air.

Additionally, components produced in accordance with the invention which have been cooled after exposure to the nitriding atmosphere, polished and then oxidised are more economical to manufacture than hard chromium plating which also suffers from the disadvantage of creating effluent disposal problems. Additionally the gaseous treatment is cheaper than the above-mentioned salt bath treatment, particularly since the latter requires the double oxidising step.

Non-alloy steel components produced according to the present invention have a hard wear resistant layer and a surface having an extremely good resistance to humidity and salt spray corrosion. Such components also have a low coefficient of friction (similar to polished hard chromium plating) so that they are capable of being used in sliding applications. Further, such components possess a high surface tension which gives extremely low wettability which is of great help in a resisting humidity and salt spray corrosion attack and also have a pleasing aesthetic appearance (gloss blue/black according to the temperature employed in the oxidising treatment). Additionally, steel components which have been quenched from 550° C. to keep nitrogen in solid solution also have good fatigue and yield strength properties.

The method of the invention has the advantage that, being of an all gaseous nature, the effluent problems associated with the salt bath heat treatment process are avoided.

The method of the invention can be performed by processors with modern gaseous atmosphere heat treatment plant without the requirement for further capital investment in plating or salt bath equipment.

We have found that the mechanism of oxygen introduction upon oxidation in the gaseous state in accordance with the invention is by way of displacement of nitrogen not merely by way of absorption of oxygen.

Thus, also according to the present invention, there is provided a corrosion resistant steel component having an epsilon iron nitride layer thereon, wherein, in a surface layer portion of the epsilon iron nitride layer, at least some of the nitrogen atoms have been displaced by oxygen atoms.

It will be appreciated from the previous discussion relating to the atmospheres which can be used during heat treatment of the component in a nitriding gaseous atmosphere, that, in some embodiments, the layer which is formed on the steel component would more accurately be described as being epsilon iron carbonitride layer rather than an epsilon iron nitride layer. Thus, the term "epsilon iron nitride layer" should be interpreted accordingly in this description and in the appended claims.

The fact that the mechanism of oxygen introduction upon oxidation is by way of displacement of nitrogen rather than merely by absorption of oxygen is surprising because the resultant component has a surface finish which is visually similar to the surface finish of the known salt bath heat treated and oxidised component discussed previously. Such a salt bath heat treated and oxidised component is disclosed in "A New Approach to Salt Bath Nitrocarburising" by I. V. Etchells (Heat Treatment of Metals, 1981.4, pages 85–88) as having high contents of both oxygen and nitrogen in the component down to a depth of some 2.5 micrometers from the surface of the component. Below this, the oxygen content falls rapidly whilst the nitrogen content only falls relatively slowly. It would therefore be reasonable to have concluded that a similar structure is obtained by the process of the present invention. However, this is not the case as noted above.

In a preferred example of the invention, the surface layer portion is substantially free of nitrogen atoms.

Preferably, the surface layer portion wherein substantially all of the nitrogen atoms have been displaced by oxygen atoms extends for a depth of at least 0.2, more preferably at least 0.3, micrometer.

The resistance of the oxidised surface to corrosion is explained by the predominance of iron oxide, mainly in the form of $Fe_3O_4$ down to a depth of at least 0.1 micrometer and sometimes down to more than 1 micrometer in depth. However, to avoid oxide exfoliation, it is preferred for iron oxide to be present down to a depth not exceeding 1 micrometer.

In one embodiment, the surface layer portion has a composition approaching that of $Fe_3O_4$ in the part of the surface layer portion immediately under the surface whilst, as the depth increases, the composition has an increasing FeO content. Such a surface layer can be produced by exposing the component having the epsilon iron nitride layer thereon to air before quenching in water/oil emulsion.

In another embodiment, the part of the surface layer portion immediately below the surface has a composition approaching that of $Fe_2O_3$ but, as the depth increases, the composition becomes progressively closer to that of $Fe_3O_4$. Such composition can be produced by allowing the component having the epsilon iron nitride layer thereon to cool completely in air.

Attention is drawn to the disclosure in a Paper entitled "Reappraisal of Nitrocarburising and Nitriding when Applied to Design and Manufacture of Non-alloy Steel Automobile Components" by C. Dawes, D. F. Tranter, and C. G. Smith presented during a symposium entitled "Heat Treatment '79' organised by The Metals Society and American Society for Metals in Birmingham on 22nd to 24th May 1979. In this paper, there is disclosure of a non-alloy steel treated by a gaseous phase process to produce an epsilon surface layer. "Air cooling" of the material subsequent to gaseous heat treatment is mentioned in such Paper. However, this is not to be construed as meaning cooling in air, ie an oxidising atmosphere. The term "air cooling" was used as a term of art to mean slow cooling and to distinguish the cooling process from oil quenching which is a fast cooling process. In fact, the "air cooling" is more accurately described as "gas cooling" since cooling was effected in the same gaseous nitriding atmosphere used during the heat treatment step to produce the epsilon layer. It is to be noted that the Paper states that all the experiments were conducted in a small, sealed quench furnace. In a sealed quench furnace, cooling is effected in a chamber which is connected with the furnace chamber and contained in the same enclosure as the furnace chamber so that ingress of air into both chambers is prevented. In the case of the cooling referred to as "air cooling" in the Paper, the samples were merely allowed to remain in the furnace to cool naturally without being quenched in the quenching oil. That cooling in air did not take place can also be deduced from FIG. 2 in the Paper where the nitrogen content remains at a level consistent with epsilon iron nitride. Further indication of the the true meaning of "air cooling" as used in the aforementioned Paper is given under the heading "Corrosion Resistance" where it is made clear that the term "air cooling" means no oil protection rather than the actual use of air to effect cooling.

Figure 5:
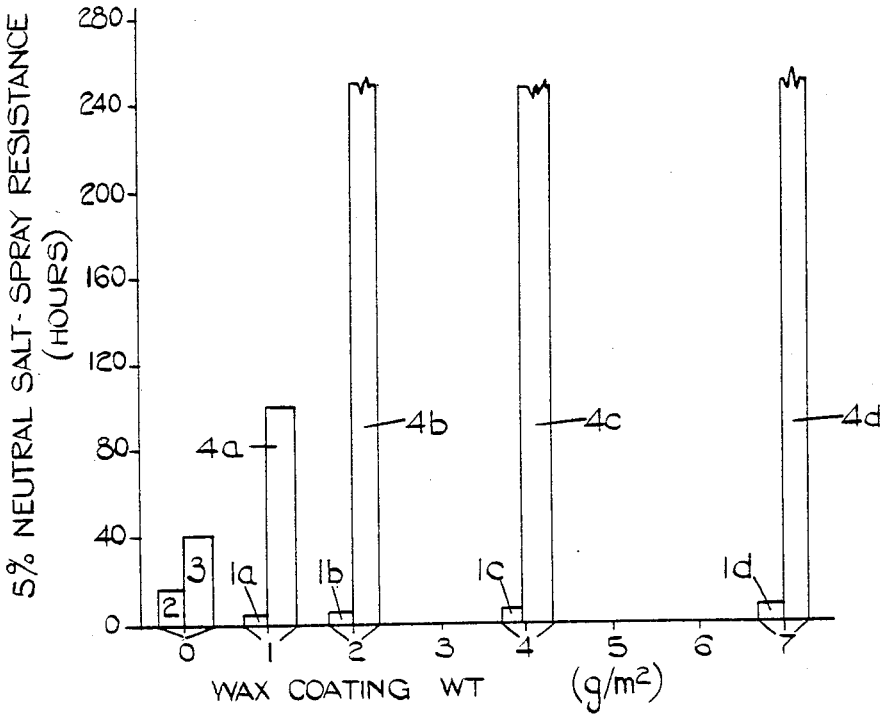
Figure 6:
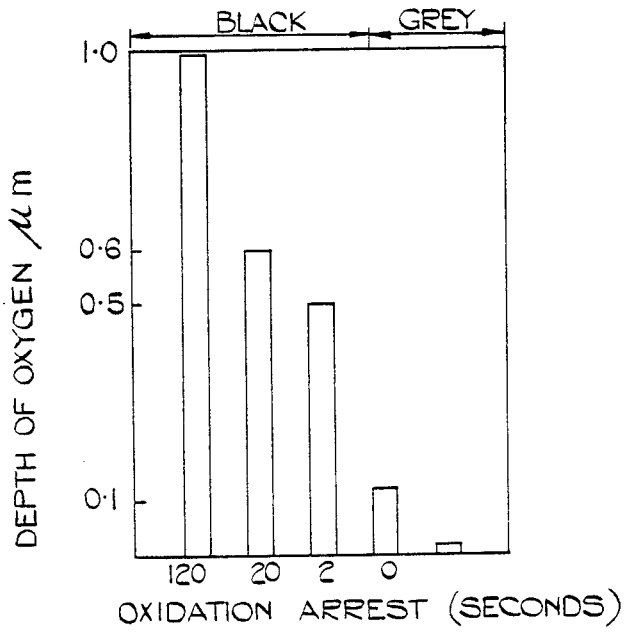

In the accompanying drawings:

FIGS. 1 to 4 are graphs plotting the iron and nitrogen, iron and oxygen, or iron, oxygen and nitrogen content in a layer region of samples of steel coponent against depth or distance from the surface of the component, FIG. 5 is a chart showing the effect of wax coating weight on salt-spray resistance and the salt spray resistance of untreated mild steel and treated mild steel, and FIG. 6 is a chart showing the effect of oxidation time in air on depth of oxide coating.

To demonstrate the effects obtained by the present invention, four mild steel test panels (low carbon (0.10%) steel to British Standard BS970 045 M10) approximately 25 mm square and 0.55 mm thick were heat treated for two hours at 570° C. in an atmosphere of 50% ammonia and 50% endothermic gas mixture (carbon monoxide, carbon dioxide, nitrogen and hydrogen). After heat treatment, the four test panels were cooled in different ways.

Sample 1 was taken straight from the heat treatment zone and, whilst in the same heat treatment atmosphere, was immediately quenched in a water-free quenching oil sold by British Petroleum under the designation QUENDILLA WA 22. This operation was effected in a sealed quench furnace.

Sample 2 was removed from the furnace, exposed to air at 20° C. for 5 seconds and then quenched in an oil-in-water emulsion produced by mixing a soluble oil sold under the Trade Mark EVOCQUENCH GW with water in an oil:water volume ratio of 1:5.5.

Sample 3 was cooled by removing it from the heat treatment furnace, exposing it to air at 20° C. for 1 second and then quenching it into an oil-in-water emulsion produced by mixing a soluble oil sold under the Trade Mark ILOTEMP 4 at an oil:water volume ratio of 1:10.

Sample 4 was removed from the furnace and merely allowed to cool completely in air at 20° C.

After cooling the samples were analysed as described below and the results obtained given in Tables 1 to 6 below.

The oil quenched samples were first vapour degreased and then all the test pieces were introduced into an Auger Electron Spectrometer which was evacuated down to a pressure of $1\times10^{-8}$ torr and allowed to remain under this reduced pressure overnight to remove any gases which had been absorbed into the surface of the samples.

All four samples were then analysed for the existence of all elements except hydrogen and helium and measured to the nearest 0.1 atomic percent of a mono layer. In the Auger Electron Spectrometer, the background vacuum was $1\times10^{-8}$ torr, the electron beam energy was 1–3 KeV, the beam current was 1 microampere and the energy range was 20–1700 eV. A layer-by-layer analysis was conducted by using the Auger Electron Spectrometer in conjunction with sequential ion beam sputtering to remove the layers. In the ion beam sputtering technique, argon ions were used at an energy of 3 keV and a current density of 75 and 150 microampere.cm$^2$ under a gas pressure of $5\times10^{-5}$ torr. The results of such analyses are given in Tables 1 to 4 below. Additionally, samples 1 and 3, in areas remote from the ion beam sputter damage, were then subjected to ball cratering using a 30 mm diameter steel ball and a 1 miro-meter diamond paste as the polising medium. The Auger Electron Spectrometer was then used to make line scans across the crater diameters and the elemental composition on these lines was measured at a number of depths between $2\times10^{-6}$ meters and $22\times10^{-6}$ meters.

The elemental compositions were initially read in atomic percentages and were then calculated as weight percentages and displayed in the Tables below.

The percentages by weight of all detectable elements present in amounts greater than 0.1% were recorded.

TABLE 1

| Depth ($10^{-9}$m) | Sample 1. Composition (wt %) Element | | | | | | |
|---|---|---|---|---|---|---|---|
| | Fe | C | N | O | S | Cl | Ca |
| 0 | 42.3 | 29.3 | 5.2 | 13.9 | 3.6 | 4.7 | 1.1 |
| 16 | 85.7 | 1.5 | 10.1 | 1.0 | 1.0 | 0.2 | 0.5 |
| 140 | 89.4 | 0.8 | 9.1 | 0.4 | 0.2 | 0 | 0 |
| 300 | 90.0 | 0.9 | 8.4 | 0.5 | 0.2 | 0 | 0 |
| 350 | 91.0 | 0.8 | 7.6 | 0.4 | 0.2 | 0 | 0 |

TABLE 2

| Depth ($10^{-9}$m) | Sample 2 Composition (wt %) Element | | | | | | | |
|---|---|---|---|---|---|---|---|---|
| | Fe | C | N | O | S | Cl | K | Na |
| 0 | 38.6 | 23.9 | 1.0 | 21.1 | 5.4 | 0.9 | 2.0 | 7.0 |
| 16 | 72.6 | 1.0 | 0 | 25.3 | 0.5 | 0 | 0.6 | 0 |
| 140 | 75.0 | 0.5 | 0 | 24.5 | 0 | 0 | 0 | 0 |
| 300 | 76.2 | 0.3 | 0 | 23.4 | 0 | 0 | 0 | 0 |

TABLE 3

| Depth ($10^{-9}$m) | Sample 3 Composition (wt %) Element | | | | | |
|---|---|---|---|---|---|---|
| | Fe | C | N | O | S | Cl |
| 0 | 57.0 | 8.9 | 0 | 31.6 | 0.7 | 1.8 |
| 16 | 72.7 | 0.3 | 0 | 27.0 | 0 | 0 |
| 140 | 74.8 | 0.2 | 0.7 | 24.3 | 0 | 0 |
| 300 | 82.7 | 0.3 | 5.1 | 12.0 | 0 | 0 |
| 430 | 83.8 | 0.3 | 6.2 | 9.8 | 0 | 0 |
| 620 | 85.6 | 0.3 | 7.4 | 6.6 | 0 | 0 |

TABLE 4

| Depth ($10^{-9}$m) | Sample 4 Composition (wt %) Element | | | | | | | |
|---|---|---|---|---|---|---|---|---|
| | Fe | C | N | O | S | Cl | K | Na |
| 0 | 46.7 | 5.0 | 1.1 | 32.9 | 0.8 | 8.7 | 3.6 | 1.1 |
| 16 | 70.5 | 0.3 | 0 | 28.8 | 0 | 0 | 0.4 | 0 |
| 140 | 73.0 | 0.1 | 0 | 26.8 | 0 | 0 | 0 | 0 |
| 300 | 73.1 | 0 | 0 | 26.9 | 0 | 0 | 0 | 0 |

TABLE 5

| Depth ($10^{-6}$m) | Sample 1 (Ball Crater) Composition (wt %) Element | | | |
|---|---|---|---|---|
| | Fe | C | N | O |
| 3.9 | 90.2 | 0.6 | 8.9 | 0.3 |
| 7.4 | 91.2 | 0.5 | 8.1 | 0.19 |
| 10.7 | 91.4 | 0.3 | 8.1 | 0.3 |
| 15.0 | 91.9 | 0.4 | 7.6 | 0.16 |
| 21.7 | 92.0 | 0.5 | 7.4 | 0.16 |

TABLE 6

| Depth ($10^{-6}$m) | Sample 3 (Ball Crater) Composition (wt %) Element | | | |
|---|---|---|---|---|
| | Fe | C | N | O |
| 2.3 | 86.8 | 0.4 | 7.4 | 5.5 |
| 4.2 | 91.0 | 0.3 | 8.4 | 0.4 |
| 6.2 | 91.1 | 0.4 | 8.2 | 0.3 |
| 9.5 | 91.6 | 0.4 | 7.9 | 0.2 |
| 11.2 | 91.5 | 0.5 | 7.9 | 0.2 |

Additionally, a more detailed measurement of the variations in the elemental composition of the layers was carried out on a new area of sample 3 in the first few microns. The results obtained are shown in Table 7 below:

TABLE 7

| Depth ($10^{-6}$m) | Sample 3 Composition (wt %) Element Fe | C | N | O | S |
|---|---|---|---|---|---|
| 0.3 | 83.0 | 0.4 | 5.0 | 11.4 | 0.2 |
| 0.4 | 84.1 | 0.5 | 5.2 | 10.3 | 0 |
| 0.6 | 85.0 | 0.3 | 5.7 | 9.0 | 0 |
| 0.9 | 86.4 | 0.3 | 6.3 | 7.0 | 0 |
| 1.3 | 85.9 | 0.3 | 6.9 | 6.9 | 0 |
| 1.6 | 86.3 | 0.14 | 6.6 | 6.9 | 0 |
| 2.3 | 87.3 | 0.2 | 5.8 | 6.6 | 0 |
| 2.9 | 88.9 | 0.2 | 6.0 | 4.9 | 0 |
| 3.9 | 90.6 | 0.4 | 6.1 | 2.9 | 0 |
| 4.9 | 92.1 | 0 | 6.6 | 1.3 | 0 |

When considering the above Tables, it is to be appreciated that the heat treatment process to which the samples were subjected is one which produces an epsilon iron carbonitride layer to a depth well in excess of 20 micrometers. The epsilon iron carbonitride layer consists of a porous and a non-porous region, the porous region extending from the surface of the sample downwardly to a depth of about 10 micrometers, and the non-porous region underlying this At a depth of 20 micrometers, the epsilon iron carbonitride layer has a typical elemental composition of 92% by weight of iron, 7.4% by weight of nitrogen, 0.4% by weight of carbon and 0.2% by weight of oxygen.

In this case of Sample 1, the elemental composition for the whole layer is consistent with the epsilon iron carbonitride region of the ternary iron-carbon-nitrogen system defined by Naumann and Langescheid (Eisenhetten-Wesen 1965, 36,677). The layer of Sample 1 is also consistent with the idealized iron nitride formula $Fe_2N_{1-x}$ where x is 0 to 1, for the epsilon phase reported by Lightfoot and Jack in "Kinetics of Nitriding With and Without White Layer Formation" (Proceedings of Heat Treatment Conference 1973 organized by Heat Treatment and Joint Committee of the Iron and Steel Institute), the nitrogen content being between 7.5 and 11% by weight.

In order to present the information more clearly, reference is drawn to attached FIGS. 1 to 4 which are graphs plotting the iron and nitrogen, iron and oxygen, or iron, oxygen and nitrogen contents in a layer region of Samples 1 to 4 respectively. The layer region chosen is one which extends from $16\times10^{-9}$ meters to about $400\times10^{-9}$ meters from the surface. The first measurement plotted on the graph is that at $16\times10^{-9}$ meters, the samples having been subjected to an initial ion sputtering technique to remove foreign contaminants from the outer surface.

As can be seen from the above Tables and Figures, oxidation of the Samples after heat treatment either solely in air or initially in air and followed by quenching in the oil/water emulsion results in displacement of nitrogen by oxygen. Displacement of nitrogen is total in the outermost surface layers portions (i.e. down to a depth which may vary between 0.1 micrometer and 1 micrometer,) depending upon the time of exposure to air while the sample is hot before quenching, and also on the cooling rate in the quench. Partial displacement of the nitrogen continues in some instances to depths in excess of 1 micrometer.

Samples 2 and 3 were corrosion resistant because of the predominance of iron oxide mainly in the form of $Fe_3O_4$ to depth of at least 0.1 micrometer and sometimes down to more than 1 micrometer in depth.

In Sample 4, the iron to oxygen ratio at the extreme surface indicates a composition approaching that of $Fe_2O_3$ but as the depth increases into the layer, the composition becomes progressively closer to that of $Fe_3O_4$.

In Samples 2 and 3, the iron to oxygen ratio suggests a structure close to $Fe_3O_4$ in the outer surface layer portions but increasing in FeO on progression inwards.

Figure 2:
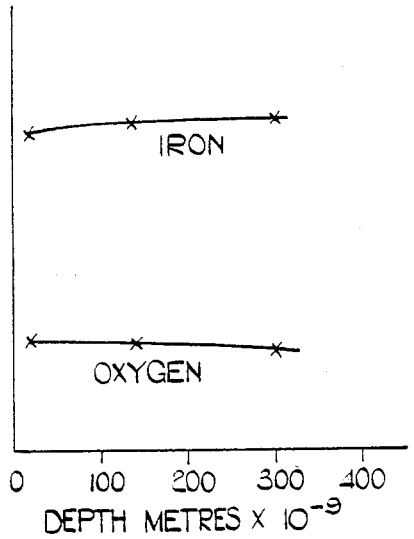
Figure 3:
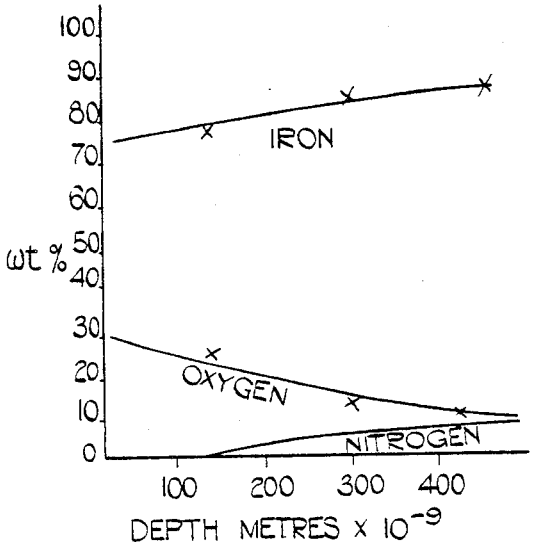
Figure 4:
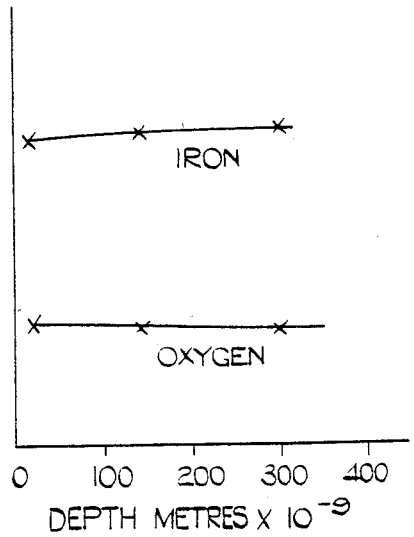

It will be appreciated from comparison of Tables 2 and 3 and FIGS. 2 and 3 that the control of the time in air at the pre-quench temperature and also the cooling speed in the quench medium is extremely critical with respect to displacement of nitrogen from the outer surface layer portions.

Lastly, it will be apparent from an examination of the Tables and Figures that the oxygen actually displaces nitrogen from the lattice, in some cases totally and in other cases to a lesser extent but still to an extent of about 90% removal down to a depth of about 0.15 micrometer This is in direct contrast to the reported effects obained by salt bath oxidation following salt bath nitriding where oxygen is reported as being simply absorbed into the nitride lattice.

Referring now to FIG. 5, the blocks illustrated therein relate to the following:

| | |
|---|---|
| Blocks 1a, 1b, 1c and 1d | results obtained by dipping an untreated mild steel component in a wax composition to give specified wax coating weight, |
| Block 2 | result obtained by nitrocarburizing a mild steel component followed by quenching in oil without oxidation by exposure to air, followed by degreasing (grey finish). |
| Block 3 | result obtained by nitrocarburizing a mild steel component followed by oxidation in air and then quenching in an oil/water emulsion, followed by degreasing. (black finish) |
| Blocks 4a, 4b, 4c and 4d | results obtained by degreasing the black component of block 3 above and then dipping to give the specified wax coating weight |

In the above, oxidation in air was effected for 10 seconds.

The wax coating composition employed comprised a mixture of waxy aliphatic and branched chain hydrocarbons, calcium soaps of oxidized petrolatum and calcium resinate to produce a wax of the requisite hardness at room temperature. The wax was contained in a mixture of liquid petroleum hydrocarbons consisting of white spirits and $C_9$ and $C_{10}$ aromatics The following specific wax compositions were employed:

For blocks 1a and 4a: Castrol V409 containing 7.5 wt% wax.

For blocks 1b and 4b: Castrol V407 containing 10 wt% wax.

For blocks 1c and 4c: Castrol V425 containing 15 wt% wax

For blocks 1d and 4d: Castrol V428 containing 30 wt% wax

With reference to FIG. 6, the first four blocks relate to exposure of nitrocarburised component at above 550° C. to air for the specified time, followed by quenching in a water/oil emulsion. The last block relates to quenching of a nitrocarburized component directly into oil without exposure to air.

It will be noted in FIG. 5 that the salt-spray resistance times for blocks 4b, 4c and 4d are depicted as of indefinite duration. In fact the tests on these blocks were stopped after 250 hours when the salt-spray resistance was found not to have deteriorated. Steel components according to the present invention have a corrosion resistance which is superior even to components surface treated to produce an epsilon iron nitride surface layer, oil quenched, degreased (or slow cooled under a protective atmosphere) and then dipped in a de-watering oil so that the de-watering oil is absorbed into an absorbent outer portion of the epsilon iron nitride surface layer. Table 8 below compares the corrosion resistant properties of various types of steel component:

TABLE 8

| SAMPLE NO | SALT SPRAY RESISTANCE (HOURS) |
|---|---|
| 1 | 0 |
| 2 | 17 |
| 3 | 96 |
| 4 | 150+ |
| 5 | 250+ |

The salt spray resistance was evaluated in a salt spray test in accordance with ATSM Standard B117-64 in which the component is exposed in a salt spray chamber maintained at 95+2−3° F. to a salt spray prepared by dissolving 5+/−1 parts by weight of salt in 95 parts of distilled water and adjusting the pH of the solution such that, when atomised at 95° F., the collect solution has a pH in range of 6.5 to 7.2 After removal from the salt spray test, the components are washed under running water, dried and the incidence of red rusting is assessed. Components exhibiting any red rusting are deemed to have failed.

In the above Table 8, the samples are identified as follows:

Sample 1=a plain, ie untreated steel component.

Sample 2=a steel component having an epsilon iron nitride surface layer produced by the first gaseous heat treatment process in the method of the invention, followed by oil quenching and degreasing (or slow cooling under a protective atmosphere).

Sample 3=the steel component of Sample 2 additionally dipped in a de-watering oil.

Sample 4=the steel component having an epsilon iron nitride layer and an oxide-rich surface ayer according to the present invention produced after lapping the surface to a finish of 0.2 micrometers.

Sample 5=a steel component having an epsilon iron nitride layer and an oxide-rich layer according to the present invention plus dipping in wax formulation V425 containing 15% wax.

It is to be noted that, in the case of Sample 4, the actual salt spray resistance figure depends upon the surface finish. In a particular example, the steel component treated is a shock absorber Piston rod with a final surface finish of 0.13 to 0.15 micrometers Ra. Such a component was found to have a salt spray resistance of 250 hours.

The improvement in fatigue properties will become apparent from an examination of Table 9 below:

TABLE 9

| SAMPLE | ENDURANCE LIMIT AT $10^7$ Cycles N/mm$^2$ | |
|---|---|---|
| | Plain | Notched |
| 6 | 250 | 190 |
| 7 | 440 | 350 |
| 8 | 260 | 195 |
| 9 | 435 | 345 |

The fatigue property was evaluated using an NPL-type two point loading rotary beam machine employing standard 0.30" (7.6 mm) diameter NPL test pieces.

In Table 9 above:

Sample 6=an untreated steel component.

Sample 7=a steel component which has an epsilon iron nitride surface layer formed thereon by heat treatment at 570° C. for about 2 hours in an atmosphere of 50% ammonia and 50% endothermic gas mixture, followed by oil quenching.

Sample 8=a steel component having an epsilon iron nitride layer produced as in Sample 7 above, and subsequently oxidised in a sodium/potassium hydroxide/sodium nitrate salt bath mixture (sold as "Degussa AB1 salt") at a temperature of 400° C. as recommended by the suppliers of the salt mixture.

Sample 9=a steel component having an epsilon iron nitride surface layer formed by heat treatment as in Sample 7 but subsequently oxidised in steam at 540° C. for 30 minutes, followed by oil quenching.

It will be seen that oxidation using the salt bath treatment as per Sample 8 above reduces the fatigue properties almost back to the level of Sample 6. This is caused by nitrogen being precipitated from solid solution. The gaseous oxidation technique as per Sample 9 can be applied over a much wider temperature range. Consequently by using a controlled oxidation process at 550° C. followed by oil quenching, the improved fatigue properties associated with the heat treatment process as per Sample 7 are maintained.

This occurs because at the higher temperature, most of the nitrogen remains in solid solution and is maintained therein by the subsequent oil quenching.

A specific example of the present invention will now be described:

A shock absorber piston rod having a length of 230 mm, a diameter of 12.5 mm, and an initial surface roughness of 0.13 to 0.15 micrometers Ra was manufactured by machining a bar of low carbon steel (BS970-045M10) and was heat treated for two hours at 570° C. in an atmosphere of 50% ammonia and 50% endothermic gas mixture (Carbon monoxide, carbon dioxide, nitrogen and hydrogen). The rod was then cooled slowly under the protection of the same atmosphere as used in the above mentioned heat treatment. The resultant rod had a 20 micrometer thick layer of epsilon iron nitride thereon and a surface roughness of 0.64 micrometers Ra.

In view of the high surface finish requirements for the piston rod, it was lapped at this stage to a surface roughness of 0.13 micrometers Ra.

Following this, the rod was oxidised in an exothermic gas mixture containing its moisture of combustion for 10 minutes at 400° C. to produce a 0.5 micrometer thick oxide-rich surface layer. The piston rod was then cooled by water quenching.

The piston rod was found to have a salt spray resistance of 250 hours according to the above described salt spray test.

In a modification of the above described specific example, the rod was oxidised for 15 minutes at 400° C. in the exothermic gas mixture, but during the last 5 minutes of the 15 minute cycle, sulphur dioxide was introduced into the furnace in an amount such as to give a concentration of 0.25% by volume in the furnace atmosphere. Such a technique caused about 1% of the iron oxide ($Fe_2O_3$) on the surface of the rod to be converted to iron sulphide which gave an aesthetically pleasing shiny black surface to the rod.

The technique of sulphiding is not restricted to components in the form of damper rods and can be used in respect of any components on which it is desirable to have a black hard-wearing surface. With surface finishes greater than 0.25 micrometers Ra, it will be necessary to wax coat in order to produce the desired corrosion resistance. To effect sulphiding, the $SO_2$ content in the oxidizing furnace may be up to 1% by volume and the temperature may be in the range of 300° C. to 600° C. The $SO_2$ will normally be added to the furnace at some stage after the oxidizing heat treatment has started in order to convert some of the already formed iron oxide to iron sulphide.

The invention is particularly applicable to non-alloy steels having a low carbon content, for example up to 0.5% carbon.

We claim:

1. A method of manufacturing a corrosion resistant non-alloy steel component comprising the steps of nitriding a non-alloy steel component and producing an epsilon iron nitride surface layer thereon, and subsequently heat treating the component in an oxidising atmosphere to provide an oxiderich surface layer consisting mainly of $Fe_3O_4$, said layer having a thickness which does not exceed 1 micrometer, and then quenching the component into an oil/water emulsion with the component at a temperature such that nitrogen is retained in solid solution in the ferritic matrix of the steel microstructure.

2. A method as claimed in claim 1 wherein the oxidising heat treatment is effected by exposing the component to air for from 2 to 20 seconds.

3. A method as claimed in claim 1 wherein the oxidising heat treatment is effected so that the oxide rich layer has a thickness of at least 0.2 micrometer.

4. A method as claimed in claim 3, wherein the oxidising heat treatment is effected so that the oxide rich layer has a thickness of 0.2 to 0.7 micrometer.

5. A method as claimed in claim 3, wherein the oxidising heat treatment is effected so that the oxide-rich layer has a thickness of 0.5 micrometer.

6. A method as claimed in claim 1 in which the component is degreased and then a wax is applied thereto.

7. A method as claimed in claim 6, wherein the wax is provided by a tack-free wax composition.

8. A method as claimed in claim 7, wherein the wax is applied in an amount of up to 7 g of the wax composition per square meter of component surface.

9. A method as claimed in claim 8, wherein the wax is applied in an amount of 2 to 7 g of the wax composition per square meter of component surface.

10. A method as claimed in claim 9 wherein the nitriding step is effected by heat treatment in a gaseous nitriding atmosphere.

11. A method as claimed in claim 10, wherein the nitriding step is effected as a temperature of 610° to 720° C.

12. A nitrided corrosion resistant non-alloy steel component comprising:

(a) a ferritic matrix bearing nitrogen in solid solution in the steel microstructure thereof, (b) an epsilon iron nitride or carbonitride layer of at least about 15 micrometers on said ferritic matrix, said epsilon iron nitride or carbonitride layer having an outer porous portion, (c) an oxide-rich layer consisting mainly of $Fed_3O_4$ and having a thickness of at least about 0.2 micrometers and which does not exceed about 1 micrometer on the epsilon nitride layer and (d) an oil or wax layer absorbed into the outer porous portion of the epsilon nitride layer.

13. A steel component according to claim 12 wherein said surface layer is at least 90% entirely $Fe_3O_4$.

14. A steel component according to claim 12 wherein said surface layer is substantially entirely $Fe_3O_4$.

15. A steel component according to claim 12 wherein said surface layer also contains iron sulfide.

16. A steel component according to claims 12, wherein the wax in the epsilon nitride layer is a hard non-tacky wax.

17. A steel component according to claims 12, wherein the wax is present in an amount of at least about $2g/m^2$.

* * * * *